US007179134B2

(12) United States Patent
Harasawa et al.

(10) Patent No.: US 7,179,134 B2
(45) Date of Patent: Feb. 20, 2007

(54) ELECTRIC CONNECTOR FOR ELECTRICALLY CONNECTING A WIRE OF ONE ARTICLE TO A CONTACT OF ANOTHER ARTICLE

(75) Inventors: Masaaki Harasawa, Yokohama (JP); Saburou Kase, Tokyo (JP); Satoru Kihara, Kawasaki (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/017,983

(22) Filed: Dec. 13, 2001

(65) Prior Publication Data

US 2002/0076994 A1 Jun. 20, 2002

(30) Foreign Application Priority Data

Dec. 18, 2000 (JP) ..... 2000-384528

(51) Int. Cl.
*H01R 13/514* (2006.01)

(52) U.S. Cl. ..... 439/752; 439/862

(58) Field of Classification Search ..... 439/350–357, 439/751–752, 404–407, 676, 946.2
See application file for complete search history.

(56) References Cited

U.S. PATENT DOCUMENTS

| | | | | |
|---|---|---|---|---|
| 3,680,035 | A | 7/1972 | Teagno et al. | 439/329 |
| 3,742,430 | A | 6/1973 | Cairns et al. | 439/862 |
| 4,087,151 | A | 5/1978 | Robert et al. | 439/188 |
| 4,209,217 | A | 6/1980 | Gudaitis et al. | 439/372 |
| 4,295,009 | A | 10/1981 | Weidler | 179/110 A |
| 4,558,270 | A | 12/1985 | Liautaud et al. | 320/2 |
| 4,778,407 | A * | 10/1988 | Myers | 439/443 |
| 5,051,100 | A | 9/1991 | Kato et al. | 439/140 |
| 5,090,925 | A | 2/1992 | Sato et al. | 439/862 |
| 5,231,659 | A | 7/1993 | Abraham et al. | 379/433 |
| 5,232,373 | A | 8/1993 | Sawada | 439/140 |
| 5,271,740 | A | 12/1993 | Endo et al. | 439/637 |
| 5,308,265 | A | 5/1994 | Kaneko | 439/752 |
| 5,456,617 | A | 10/1995 | Chishima et al. | 439/513 |
| 5,458,502 | A | 10/1995 | Joly | 439/397 |
| 5,484,295 | A | 1/1996 | Mowry et al. | 434/66 |
| 5,605,150 | A | 2/1997 | Radons et al. | 128/630 |
| 5,647,778 | A | 7/1997 | Yamaguchi et al. | 439/752 |
| 5,676,562 | A | 10/1997 | Fukuda | |
| 5,718,597 | A | 2/1998 | Kodama | |
| 5,746,607 | A | 5/1998 | Bricaud et al. | 439/66 |
| 5,891,591 | A | 4/1999 | Suzuki | |
| 5,897,402 | A | 4/1999 | Sasai et al. | 439/752 |
| 5,947,775 | A | 9/1999 | Yamamoto et al. | |
| 5,975,914 | A | 11/1999 | Uchida | 439/66 |
| 5,980,322 | A * | 11/1999 | Madsen et al. | 439/621 |
| 6,022,224 | A | 2/2000 | Peters | 439/66 |
| 6,095,831 | A | 8/2000 | Muramatsu et al. | |
| 6,095,855 | A | 8/2000 | Iwata et al. | 439/553 |
| 6,099,356 | A | 8/2000 | Hwang | 439/660 |
| 6,102,722 | A * | 8/2000 | Arnett | 439/676 X |
| 6,126,458 | A * | 10/2000 | Gregory, II et al. | 439/76.2 |
| 6,126,496 | A | 10/2000 | Shinozaki | |
| 6,135,828 | A | 10/2000 | Lalange et al. | |
| 6,217,396 | B1 | 4/2001 | Hwang et al. | |
| 6,280,262 | B1 | 8/2001 | Tanaka | 439/752 |
| 6,309,262 | B1 | 10/2001 | Morris | 439/862 |
| 6,315,621 | B1 | 11/2001 | Natori et al. | 439/862 |
| 6,343,960 | B1 | 2/2002 | Sato | 439/701 |
| 6,589,082 | B2 | 7/2003 | Harasawa et al. | 439/752 |
| 2003/0211787 | A1 * | 11/2003 | Harasawa et al. | 439/862 |

FOREIGN PATENT DOCUMENTS

| | | |
|---|---|---|
| CN | 1177675 | 4/1998 |
| DE | 196 11 422 | 9/1997 |
| EP | 0 822 616 | 2/1998 |
| FR | 2497007 | 6/1982 |
| FR | 2 566 589 | 12/1985 |
| JP | 53-163582 | 5/1952 |
| JP | 55-9019 | 1/1980 |
| JP | 57-12671 | 1/1982 |
| JP | 58-44775 | 3/1983 |
| JP | 62-12281 | 1/1987 |
| JP | 1-142167 | 9/1989 |
| JP | 1-168970 | 11/1989 |
| JP | 4-72488 | 6/1992 |
| JP | 4-135176 | 12/1992 |
| JP | 6-7177 | 1/1994 |

| | | |
|---|---|---|
| JP | 6-29064 | 4/1994 |
| JP | 6-31094 | 4/1994 |
| JP | 06-215833 | 8/1994 |
| JP | 08-022871 | 1/1996 |
| JP | 9-073951 | 3/1997 |
| JP | 09-237650 | 9/1997 |
| JP | 09306576 | 11/1997 |
| JP | 10-255931 | 9/1998 |
| JP | 10-340750 | 12/1998 |
| JP | 11-144801 | 5/1999 |
| JP | 2000-150087 | 5/2000 |
| JP | 2001-307799 | 11/2001 |
| JP | 2002184489 | 6/2002 |

OTHER PUBLICATIONS

"Electric Connector", by Masaaki Harasawa et al.; U.S. patent application 10/017,977; Dec. 13, 2001, pp. 1 to 27 and 18 sheets of drawings.

"Electric Connector", by Masaaki Harasawa et al.; U.S. patent application 10/017,987, Dec. 13, 2001, pp. 1 to 32 and 17 sheets of drawings.

Horikoshi et al.; U.S. patent application Publication No. 2002/0048975 A1, Publication Date: Apr. 25, 2002, entitled: "Electrical Connection Structure for Electronic Apparatus", cover sheet, 10 sheets of drawings and pp. 1 to 6.

* cited by examiner

*Primary Examiner*—Michael C. Zarroli
(74) *Attorney, Agent, or Firm*—W. F. Fasse; W. G. Fasse

(57) ABSTRACT

An electric connector for electrically and mechanically connecting two articles, each having a conductive part, is able to reduce the number of electric connectors used in a connecting structure, to reduce the connecting work so as to reduce the costs of the connecting structure, and to make the connecting structure more compact. This electric connector includes a housing, which is fitted to at least one of the articles, and a contact, which is provided on the housing and has a connecting part to be connected to a conductive part of the first article and a contacting part to be made to press against and contact a conductive part of the second article. Elastic deflectable wings or locking pawls protrude from the housing to secure the connector to at least one of the articles.

8 Claims, 15 Drawing Sheets

ELECTRIC CONNECTOR FOR ELECTRICALLY CONNECTING A WIRE OF ONE ARTICLE TO A CONTACT OF ANOTHER ARTICLE

CROSS-REFERENCE TO RELATED APPLICATIONS

This application is related to our copending U.S. patent applications Ser. Nos. 10/017,977 and 10/017,987, both filed on Dec. 13, 2001.

BACKGROUND OF THE INVENTION

1. Field of the Invention

The present invention belongs to a field of electric connectors, which are used to electrically connect two articles that are exemplified by printed circuit board, electrical part, etc.

2. Related Art

Electric connectors for electrically connecting two articles include, for example, a pair of a male type crimp connector and a female type crimp connector to be coupled together, which are used extensively. The connecting form of them is, for example, that an electric wire led out of a first article is crimp-connected to a male type crimp connector, an electric wire led out of a second article is crimp-connected to a female type crimp connector, and the male type crimp connector and the female type crimp connector are coupled together to make an electrical connection.

As for the connecting structures using such electric connectors, it is keenly desired to reduce costs and to make the connectors themselves more compact and to achieve related objects.

SUMMARY OF THE INVENTION

One objective of the present invention, regarding an electric connector that is electrically connected to a first article, is to fit the connector onto the first article and/or a second article and to have a contact of the electric connector contact a conductive part of the second article, so as to reduce the number of electric connectors used in the connecting structure and to reduce the connecting work, and in turn, to reduce the costs of the connecting structure and to make the connecting structure more compact.

To accomplish the above-mentioned objective, the present invention is an electric connector that is used to electrically connect two articles each having a conductive part. This electric connector comprises a housing, which is fitted onto at least one of the articles, and a contact, which is provided on the housing and has a connecting part to be connected to a conductive part of the first article and a contacting part to be made to contact, with a pressing force, a conductive part of the second article.

When the connecting part of the contact of this electric connector is connected to the conductive part of the first article, the housing is fitted onto the first article, and the two articles are arranged in a certain positional relationship and joined together, the contacting part of the contact will contact the conductive part of the second article with a pressing force, and the conductive parts of both the articles will be electrically connected via the contact. Or, when the connecting part of the contact of this electric connector is connected to the conductive part of the first article and the housing is fitted onto the second article, the contacting part of the contact will contact the conductive part of the second article with a pressing force and the conductive parts of both the articles will be electrically connected via the contact. Or, when the connecting part of the contact of this electric connector is connected to the conductive part of the first article and the housing is fitted onto both the first article and the second article, the contacting part of the contact will contact the conductive part of the second article with a pressing force and the conductive parts of both the articles will be electrically connected via the contact.

In any of the above-mentioned connecting forms, as the contacting part of the contact will contact the conductive part of the second article with a pressing force, a contact pressure at the contacting point will be secured to reliably make an electric connection of the two articles. In this connecting structure, as the number of electric connector to be used is one in contrast with the conventional connecting structure using a pair of a male crimp connector and a female crimp connector, the costs are lowered through the reduction in the number of electric connector in use. As the work of connecting the conductive part to the electric connector, for example, crimping, can be done by a single operation, the costs are lowered through the improved workability. When the housing is fitted onto both the first article and the second article, as the two articles will be joined together with the electric connector, a separate joining means such as a screw is not needed, and the costs are reduced through the elimination of any joining means. As a single electric connector is used in the connecting structure, the space occupied by the electric connector is reduced in comparison with the conventional connecting structure wherein a pair of a male crimp connector and a female crimp connector are used, and the connecting structure is compactified.

Accordingly, the electric connector of the present invention ensures a contact pressure at the contacting point and achieves a reliable electric connection between the articles, reduces the number of required electric connectors in use and improves the workability, and in turn, achieves a significant cost reduction and compactification (i.e. size reduction) of the connecting structure. When the housing is fitted onto both the first article and the second article, costs can be reduced further through elimination of a separate joining means.

BRIEF DESCRIPTION OF THE DRAWINGS

FIG. 4A is a plan view, FIG. 4B is a front view, and FIG. 4C is a bottom view.

DESCRIPTION OF PREFERRED EMBODIMENTS OF THE INVENTION

Figure 1:
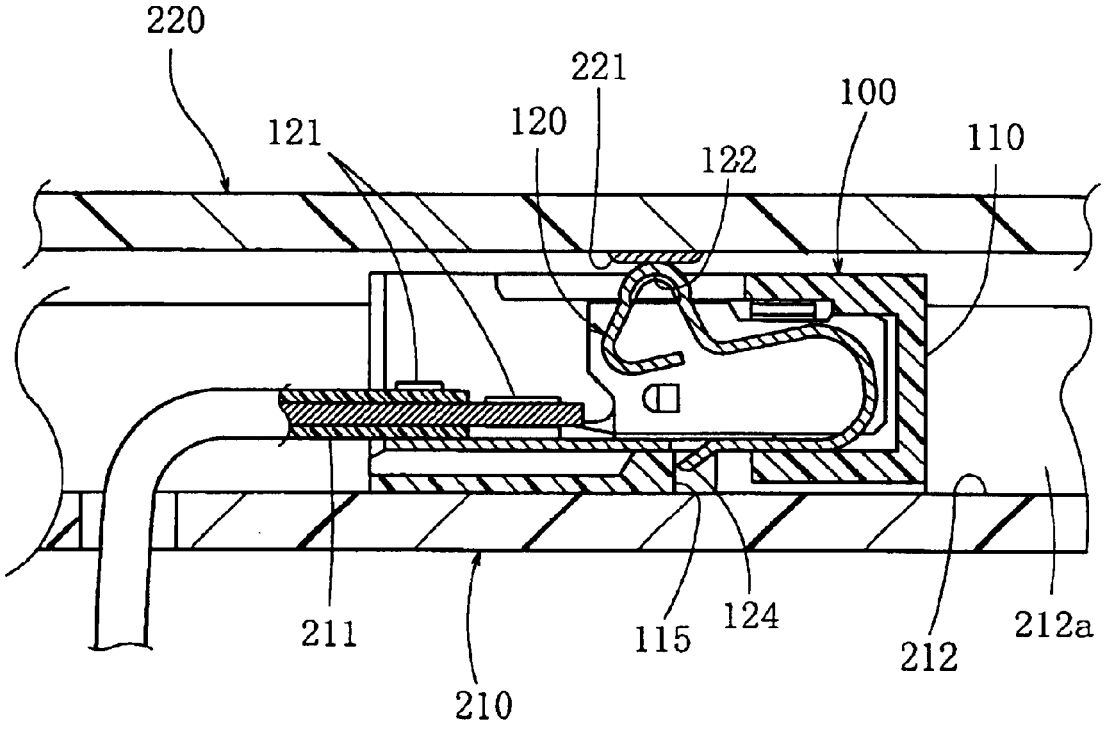
FIG. 1 is a sectional view of the electric connector of the first embodiment when it is used by fitting it onto the first article.
Figure 2:
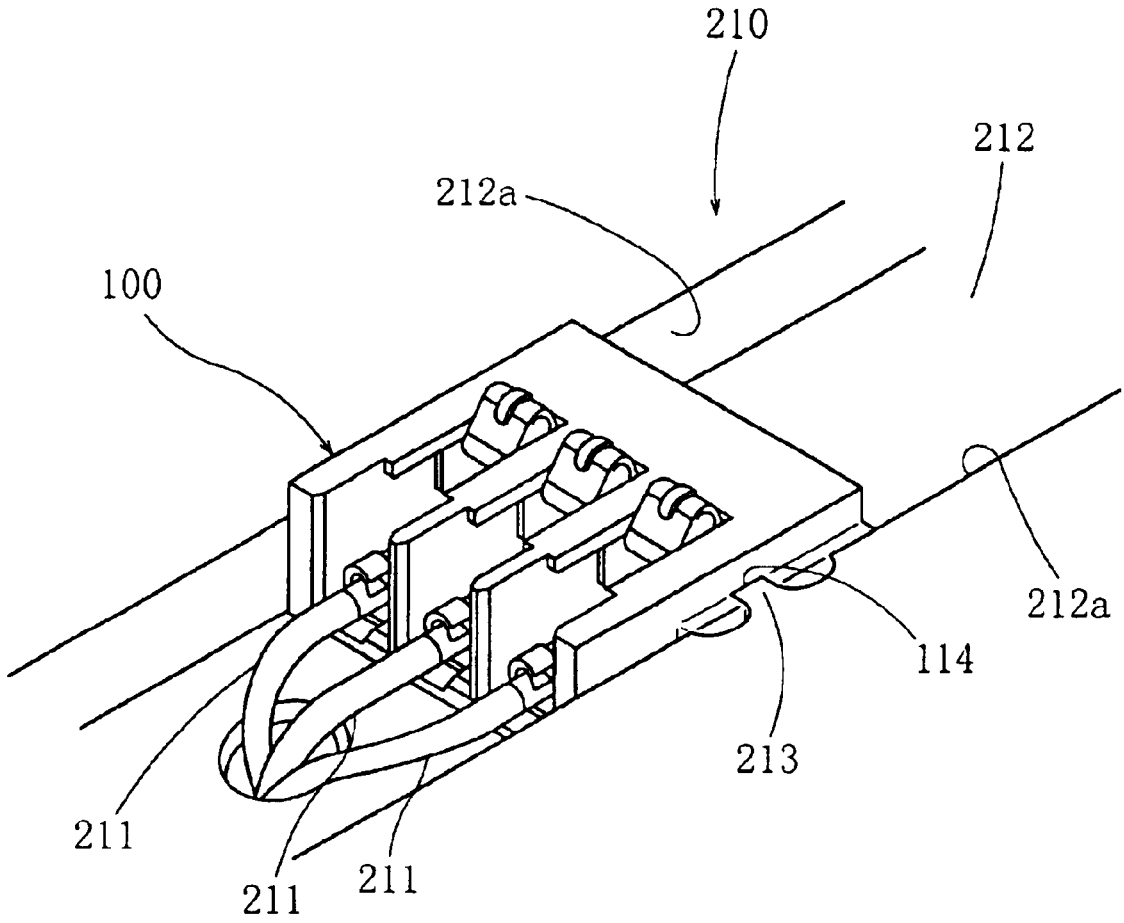
FIG. 2 is a perspective view of the electric connector of the first embodiment when it is used by fitting it onto the first article.
Figure 3:
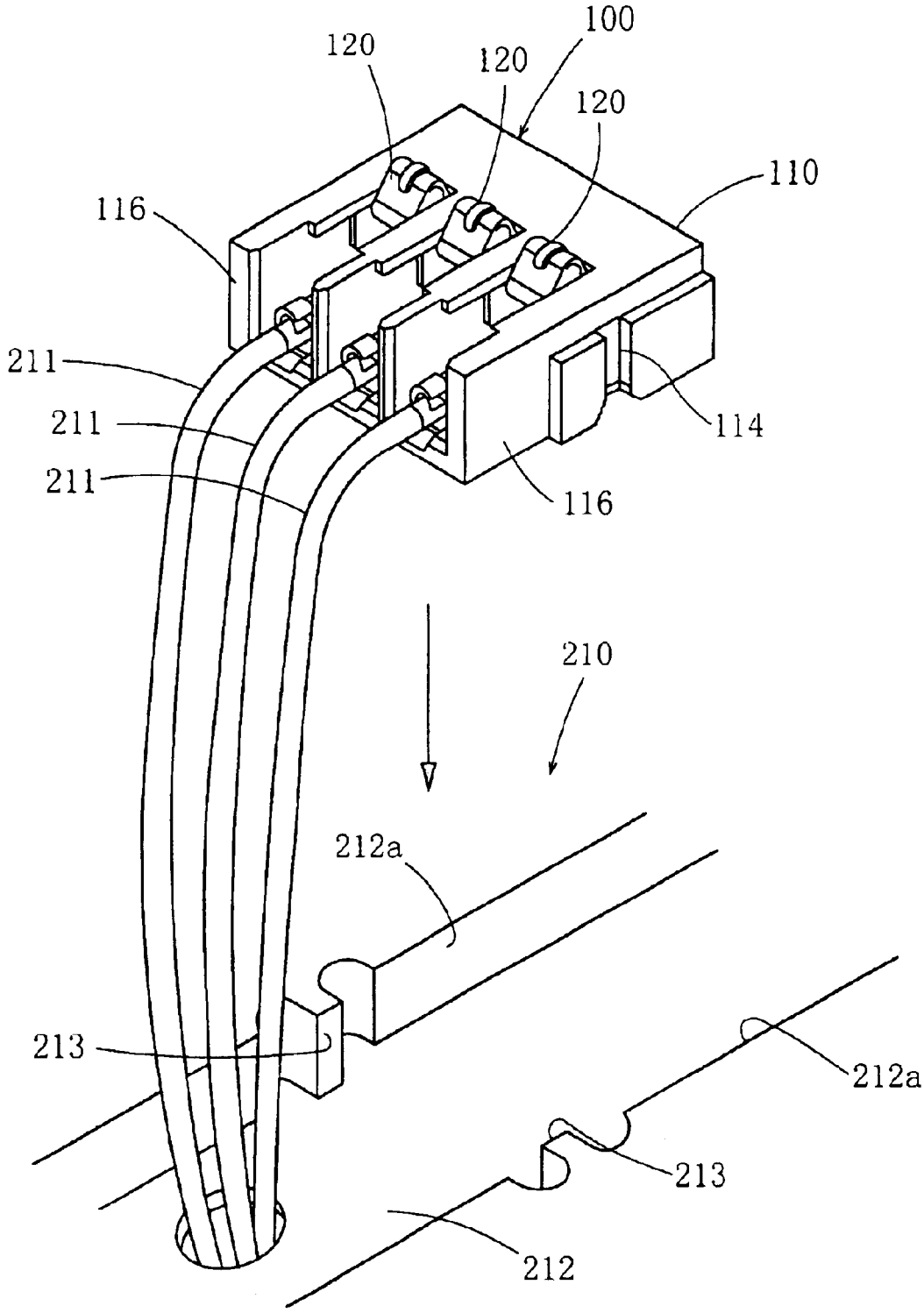
FIG. 3 is a perspective view of the electric connector of the first embodiment when it is being fitted onto the first article.

Some embodiments of the electric connector of the present invention will be described below. FIG. 1 through FIG. 3 show the electric connector 100 of the first embodiment. This electric connector 100 is used to electrically connect two articles each having a conductive part. The electric connector 100 comprises a housing 110, which is fitted onto at least either one of the articles, and a contact 120 being provided on the housing 110. Here, the first article 210 is exemplified by a casing of an electric appliance, and the conductive part 211 of the first article 210 is exemplified by an electric wire. The second article 220 is exemplified by a printed circuit board, and the conductive part 221 of the second article 220 is exemplified by a conductive pad. The concepts of the articles and conductive parts according to the present invention are not limited in any way by these exemplifications. The articles may be any corporeal things, and the conductive parts may be any members having electric conductivity.

Figure 4A:
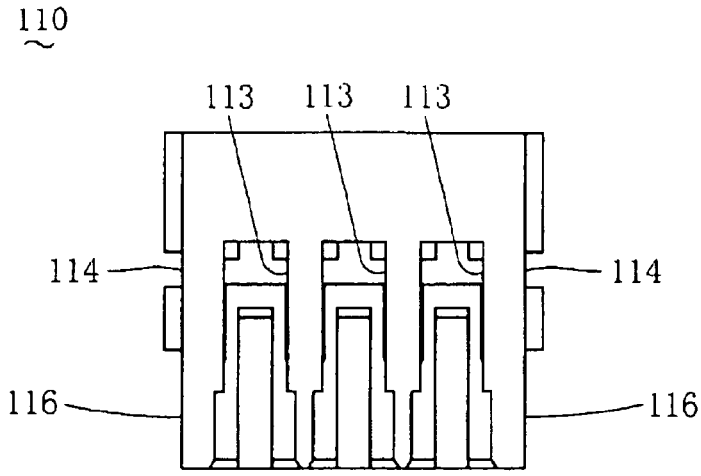
FIG. 4A, FIG. 4B and FIG. 4C show the housing of the electric connector of the first embodiment.
Figure 4B:
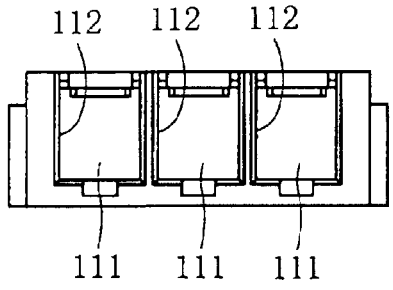
Figure 4C:
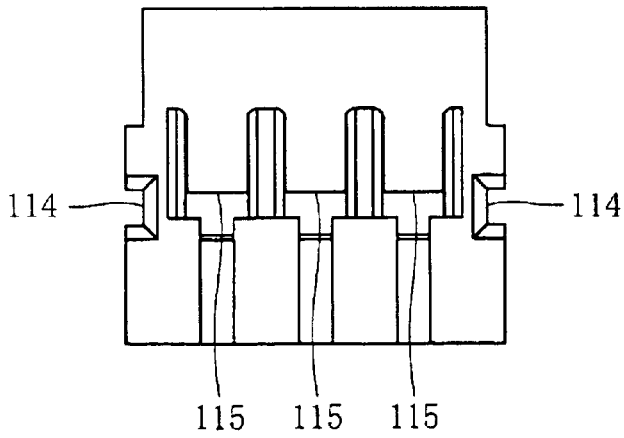

As shown in FIG. 4A, FIG. 4B and FIG. 4C, the housing 110 is formed approximately into a rectangular parallelepiped. For convenience, a direction along one side of the housing 110 is defined as the longitudinal direction, and a direction that is approximately perpendicular to that direction is defined as the width direction. A direction that is approximately perpendicular to both the longitudinal direction and the width direction is defined as the height direction. Inside the housing 110, cavities 111 being cells for storing contacts 120 are formed in the longitudinal direction. The cavities 111 as many as the contacts 120 are formed in a row in the width direction. One end, in the longitudinal direction, of each cavity 111 is opened as an insertion port 112 in one face, in the longitudinal direction, of the housing 110. Each contact 120 is to be inserted through this insertion port 112. A contact window 113 is opened through to each cavity 111 in one face, in the height direction, of the housing 110. A contacting part of the contact 120, which will be described later, is exposed through this contact window 113 to come out of the face of the housing 110. This contact window 113 is formed through to the above-mentioned insertion port 112 so that the contact 120 can be easily inserted into the cavity 111. The housing according to the present invention is not limited to the form of the approximate rectangular parallelepiped. It may be any form, which can be fitted onto the articles and into which the contacts can be assembled.

Figure 5:
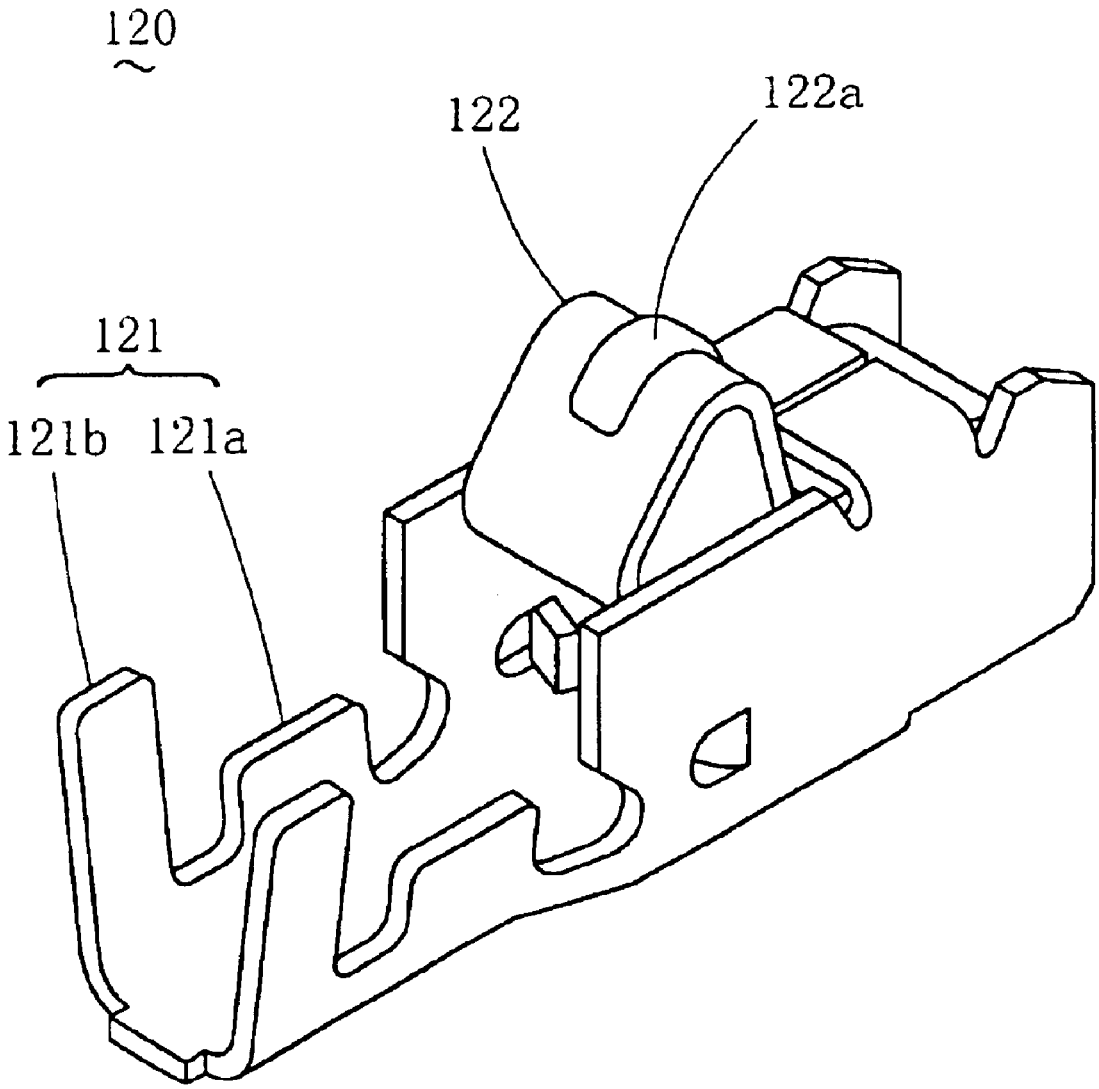
FIG. 5 is a perspective view of the contact of the electric connector of the first embodiment.

As shown in FIG. 5, the above-mentioned contact 120 is made of a member that has electric conductivity, and the contact 120 comprises a connecting part 121, which is connected to the conductive part 211 of the first article 210, and a contacting part 122, which contacts the conductive part 221 of the second article 220 with a pressing force. Here, it is exemplified by a crimp type contact 120. Hence the connecting part 121 is a barrel formed at one end of the contact 120, and this barrel comprises a wire barrel 121*a*, which crimps the core of an electric wire being the conductive part 211, and an insulation barrel 121*b*, which crimps this electric wire together with its insulation. The other end of the contact 120 is formed into an oblong rectangle when seen in the height direction and is bent to form a curve when seen in the width direction so as to function as a leaf spring, which is flexible in the height direction. In this embodiment, this end is approximately bent into a U shape in the height direction, and this bent part undergoes elastic deformation. Moreover, the top end of this end is bent approximately into an inverted-U shape in the height direction to form the contacting part 122, and this contacting part 122 comes, through the contact window 113 of the above-mentioned housing 110, out of the face of the housing 110. The configuration of the contact is not limited by this embodiment. The contact may be bent into, for example, an L shape without any curving. When necessary, a dimple 122*a* is formed in this contacting part 122 by embossing or the like to define a contacting point for the conductive part 221 of the second article 220. In this embodiment, a fitting structure with the so-called contact lance is used. In other words, the contact 120 is provided with a protruding piece 124, and this protruding piece 124 is used as a lance to be fitted into a fitting window 115 that is opened in the cavity 111 of the housing 110. In contrast with this, a fitting structure with the so-called housing lance may be used. In that case, the housing is provided with a protruding piece and this protruding piece is fitted into a fitting window of the contact. The contact may be fitted into the housing without using any lance.

The above-mentioned housing 110 is fitted onto an article by fitting itself into a concaved part that is formed in the article. In the case of the connecting form shown in FIG. 1 through FIG. 3, the housing 110 is fitted onto the first article 210. For this purpose, a groove-shaped concaved (i.e. recessed) part 212 is formed in the first article 210, and the width of the housing 110 is made to have a dimension that can fit into this concaved part 212. The electric connector 100 is fitted into this concaved part 212 in such a way that the height direction of the electric connector 100 aligns with the depth direction of the concaved part 212 and the contacting part 122 comes out of the concaved part 212. On each of the two longitudinal walls 212*a* of this concaved part 212, which are opposing to each other, a guide protrusion 213 is formed to extend in the width direction. In each of the two external walls 116, in the width direction, of the housing 110, there is formed a fitting groove 114, into which the above-mentioned guide protrusion 213 fits. The fitting grooves 114 and the guide protrusions 213 fit together with a certain pressure, and the housing 110 is fitted onto the first article 210 by this fitting (the state shown in FIG. 1 and FIG. 2). Here, fitting grooves 114 are formed in the electric connector 100 and guide protrusions 213 are formed on the concaved (i.e. recessed) part 212. However, in contrast with this, guide protrusions may be formed on the electric connector and fitting grooves may be formed in the concaved part. Here, the concaved part 212 is groove-shaped, but the concaved part may have any form provided that it can receive the electric connector therein. Moreover, instead of providing fitting grooves and guide protrusions, the external walls of the housing may be made to face-contact the longitudinal walls of the concaved part and the housing may be fitted onto the first article by this fitting. These comments also apply to the concaved parts 212, 225, which will be described in relation to the connecting forms that will be described below.

In the case of the connecting form shown in FIG. 1 through FIG. 3, when the connecting part 121 of the contact 120 of this electric connector 100 is connected to the conductive part 211 of the first article 210, the housing 110 is fitted onto the first article 210, and the two articles 210, 220 are arranged in a certain positional relationship and joined together, the contacting part 122 of the contact 120 will contact the conductive part 221 of the second article 220 with a pressing force and the conductive parts 211, 221 of both the articles 210, 220 will be electrically connected by the contact 120. As for the method of arranging the two articles 210, 220 in a certain positional relationship and joining them together, one method, for example, may be assembling a printed circuit board being the second article 220 in a casing of an electric appliance being the first article 210 and securing them together with screws, etc.

Figure 6:
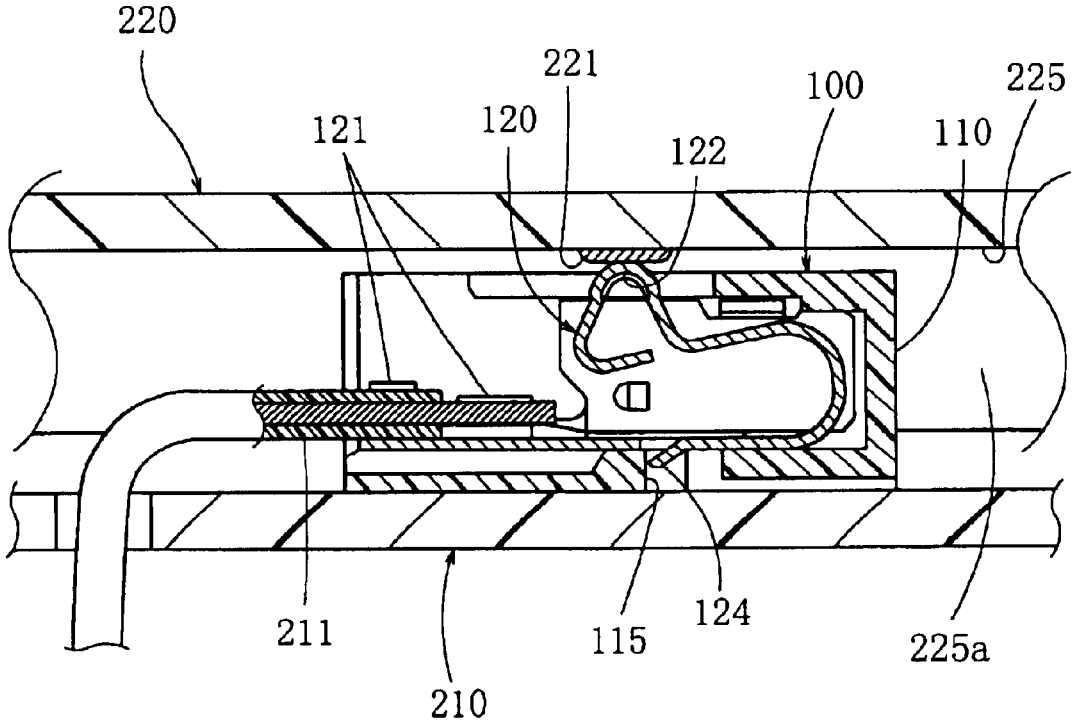
FIG. 6 is a sectional view of the electric connector of the first embodiment when the connector is used by fitting it onto the second article.
Figure 7:
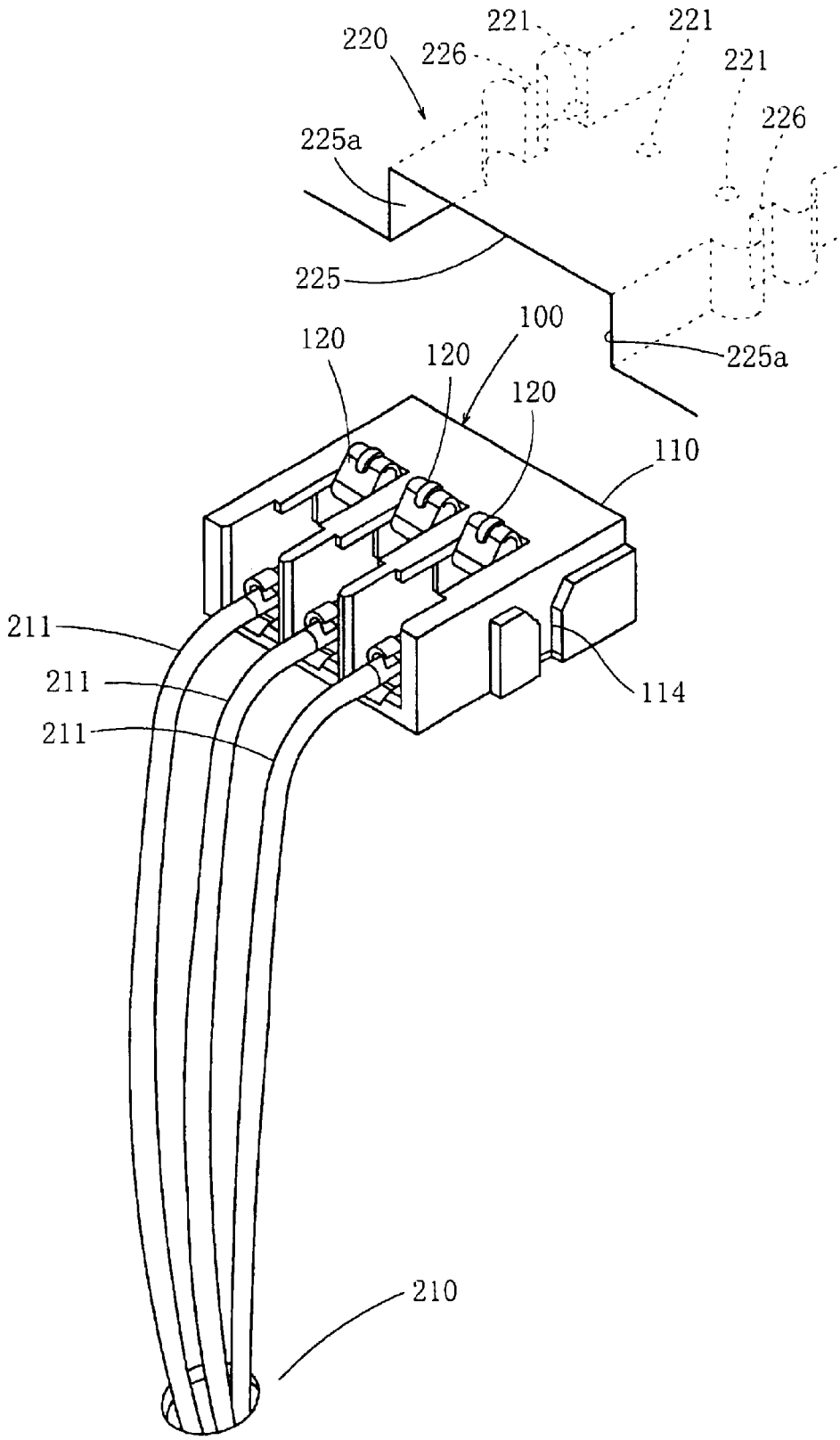
FIG. 7 is a perspective view of the electric connector of the first embodiment when it is being fitted onto the second article.

FIG. 6 and FIG. 7 show another connecting form for the electric connector 100 of the above-mentioned first embodiment. In this case, the housing 110 is fitted onto the second article 220. To this end, a groove-shaped concaved part 225 is formed in the second article 220, and the width of the housing 110 is made to have a dimension that can fit into this concaved part 225. The conductive part 221 of the second article 220 is provided on the bottom of the concaved part 225. The electric connector 100 is fitted into this concaved part 225 in such a way that the height direction of the electric connector 100 aligns with the depth direction of the concaved part 225 and the contacting part 122 opposes to the bottom of the concaved part 225. On each of the two longitudinal walls 225*a* of this concaved part 225, which are opposing to each other, a guide protrusion 226, which fits into a fitting groove 114 of the housing 110, is formed in the depth direction. These fitting grooves 114 and the guide protrusions 226 fit together with a certain pressure, and the housing 110 is fitted onto the second article 220 by this fitting.

In the case of this connecting form, when the connecting part 121 of the contact 120 of the electric connector 100 is connected to the conductive part 211 of the first article 210, and the housing 110 is fitted onto the second article 220, the contacting part 122 of the contact 120 will contact the conductive part 221 of the second article 220 with a pressing force, and the conductive parts 211, 221 of both the articles 210, 220 will be electrically connected by the contact 120.

Figure 8:
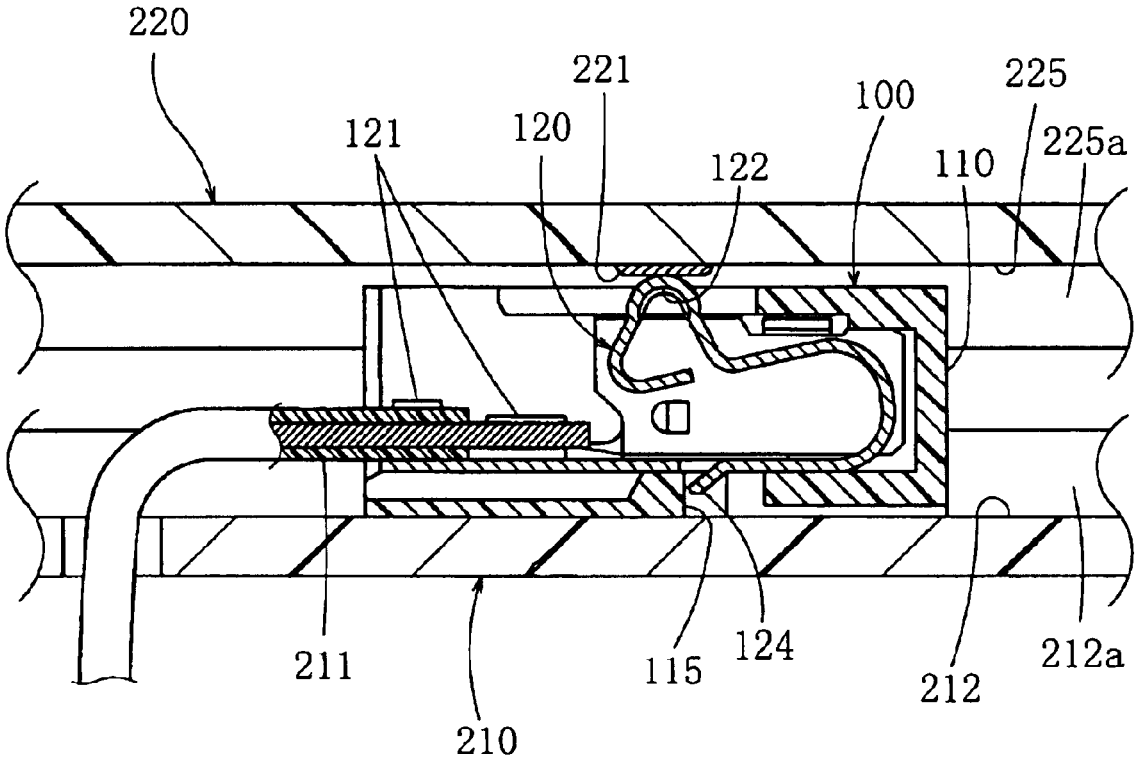
FIG. 8 is a sectional view of the electric connector of the first embodiment when it is fitted onto both the first article and the second article.

FIG. 8 shows another connecting form of the electric connector 100 of the above-mentioned first embodiment. In this case, the housing 110 is fitted onto the first article 210 and the second article 220. To this end, a groove-shaped concaved part 212 is formed in the first article 210, and a groove-shaped concaved part 225 is formed in the second article 220, respectively, and the width of the housing 110 is made to have a dimension that can be fitted into both the concaved parts 212, 225. The conductive part 221 of the second article 220 is provided on the bottom of the concaved part 225. The electric connector 100 is fitted into the concaved part 212 in such a way that the height direction of the electric connector 100 aligns with the depth direction of the concaved part 212 and the contacting part 122 comes out of the concaved part 212, and the electric connector 100 is fitted into the concaved part 225 in such a way that the height direction of the electric connector 100 aligns with the depth direction of the concaved part 225 and the contacting part 122 opposes to the bottom of the concaved part 225. Guide protrusions 213, 226 are formed on the concaved parts 212, 225, and the fitting grooves 114 and the guide protrusions 213, 226 are fitted together with a certain pressure, and the housing 110 is fitted onto both the first article 210 and the second article 220 by this fitting.

In the case of this connecting form, when the connecting part 121 of the contact 120 of the electric connector 100 is connected to the conductive part 211 of the first article 210 and the housing 110 is fitted onto both the first article 210 and the second article 220, the contacting part 122 of the contact 120 will contact the conductive part 221 of the second article 220 with a pressing force, and the conductive parts 211, 221 of both the articles 210, 220 will be electrically connected by the contact 120.

In any of the above-mentioned connecting forms, as the contacting part 122 of the contact 120 contacts the conductive part 221 of the second article 220 with a pressing force, the electric connection between the two articles is made reliably by securing a contact pressure at the contacting point. In this connecting structure the number of electric connector used is one in contrast with the conventional connecting structure wherein a pair of a male crimp connector and a female crimp connector are used. Accordingly, the costs are reduced through the reduction in the number of electric connectors used. As the work of connecting the conductive part 211 to the electric connector 100 by, for example, crimping can be done by one operation, the costs are reduced through improvement in the workability. When the housing 110 is fitted onto both the first article 210 and the second article 220, as the two articles 210, 220 are joined together by the electric connector 100, there is no need of independently joining the two articles 210, 220 by a joining means such as screws. Hence costs are reduced through elimination of a joining means. As only one electric connector is used in the connecting structure, in contrast with the conventional connecting structure using a pair of a male crimp connector and a female crimp connector, the space occupied by the electric connector is smaller and the connecting structure is more compact.

The present invention includes any forms of structure for fitting the housing of the electric connector onto an article. However, as is the case of the above-mentioned embodiment, if the housing 110 is formed to be fitted into the concaved part 212 of the article 210 and/or the concaved part 225 of the article 220 and the housing 110 is formed to be fitted onto the article 210 and/or the article 220 by this fitting-in, fitting the electric connector 100 into the concaved part 212 of the article 210 and/or the concaved part 225 of the article 220 will fit the electric connector 100 onto the article 210 and/or the article 220. Hence the workability of fitting is improved.

The present invention includes any forms of structure for connecting the connecting part of the contact to the conductive part of the article. Among them, the above-mentioned embodiment exemplifies cases wherein the contact 120 is of the crimp type.

Other embodiments will be described in the following. As the basic description of these other embodiments, the description of the first embodiment will apply in its entirety with the same reference characters. Then configurations differing from the first embodiment will be described additionally.

Figure 9:
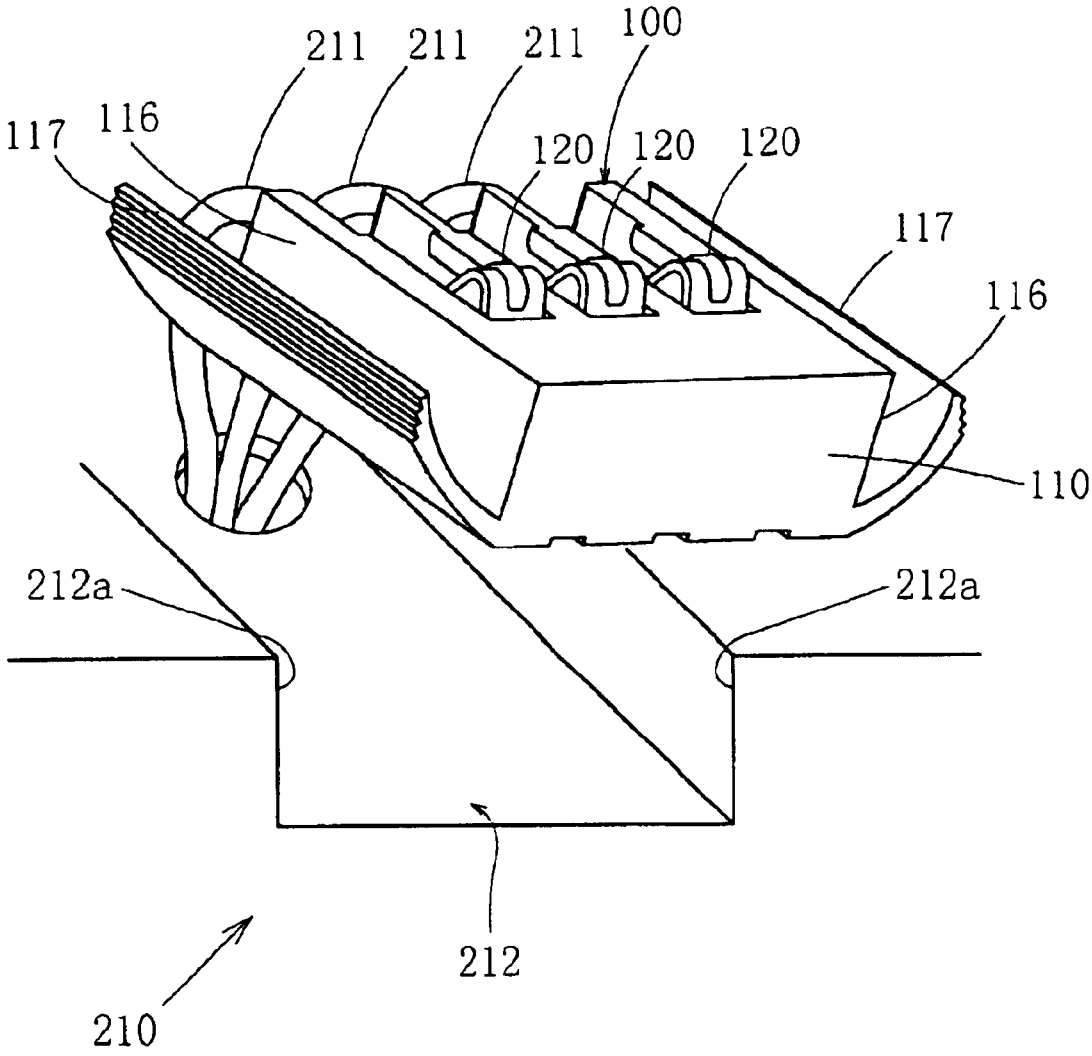
FIG. 9 is a perspective view of the electric connector of the second embodiment when it is being fitted onto the first article.
Figure 10:
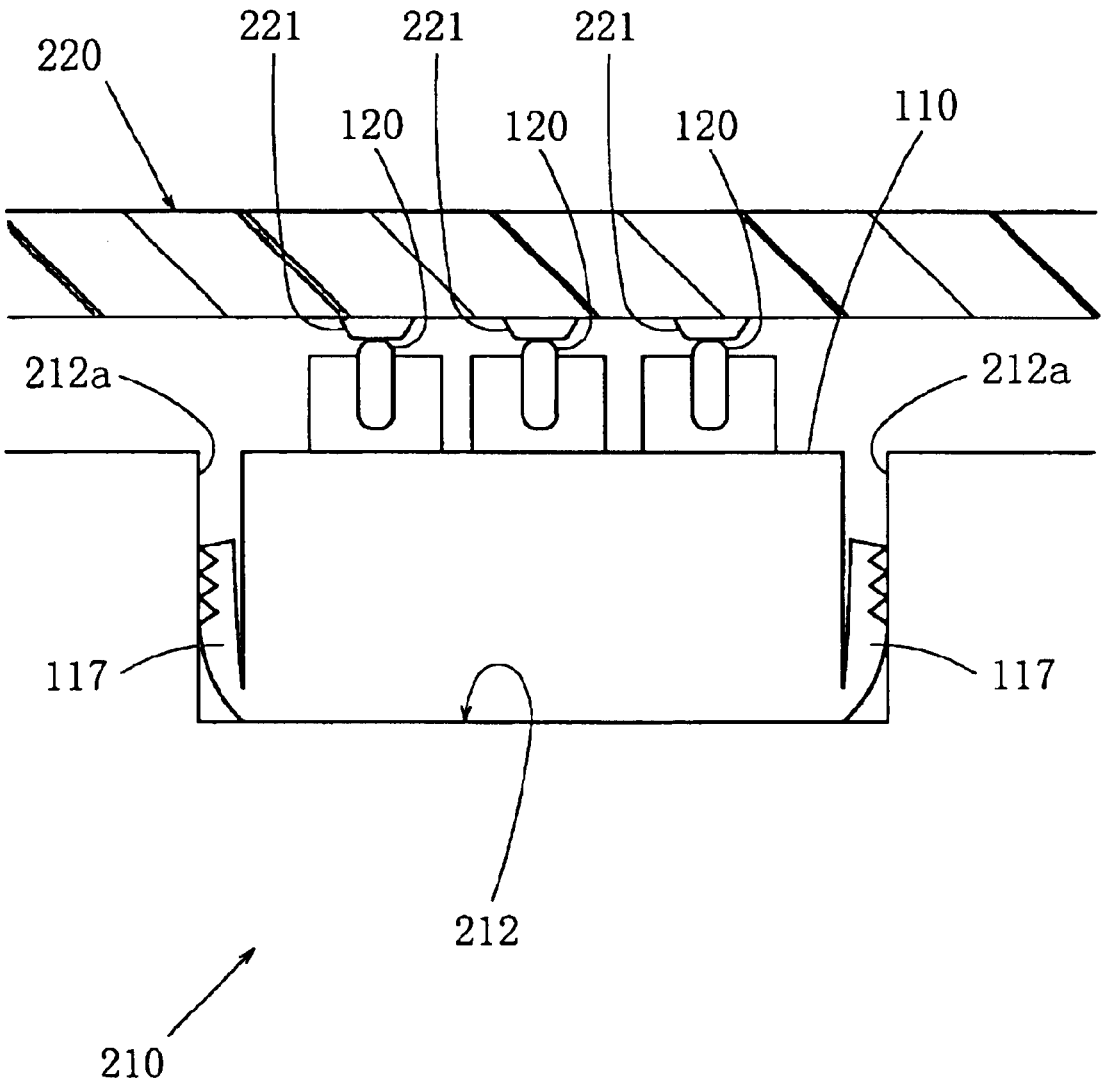
FIG. 10 is a front view of the electric connector of the second embodiment when it is fitted onto the first article.

FIG. 9 and FIG. 10 show the electric connector 100 of the second embodiment. The housing 110 of the electric connector 100 of this second embodiment is formed in such a way that it can be inserted into a concave part formed in an article and is provided with wings 117, which are elastically deformed to press against the longitudinal walls of a concaved part when the housing 110 is inserted into the concaved part. The housing 110 is fitted onto the article by the pressures of the wings 117. In this embodiment, a wing 117 is provided on each of two outside walls 116 on both ends, in the width direction, of the housing 110. In the case of the connecting form shown in FIG. 9 and FIG. 10, the housing 110 is fitted onto the first article 210. To this end, a concaved part 212 is formed in the first article 210 and the housing 110 is formed in such a way that it can be inserted into the concaved part 212, and the housing 110 is provided with wings 117, which are elastically deformed to press against the longitudinal walls 212*a* of the concaved part 212 when the housing 110 is inserted into the concaved part 212. The electric connector 100 is fitted into this concaved part 212 in such a way that the height direction of the electric connector 100 aligns with the depth direction of the concaved part 212 and the contacting part 122 comes out of the concaved part 212. The method of electrically connecting the articles 210, 220 with the electric connector 100 in this connecting form is similar to that of the connecting form shown in FIG. 1 through FIG. 3.

Figure 11:
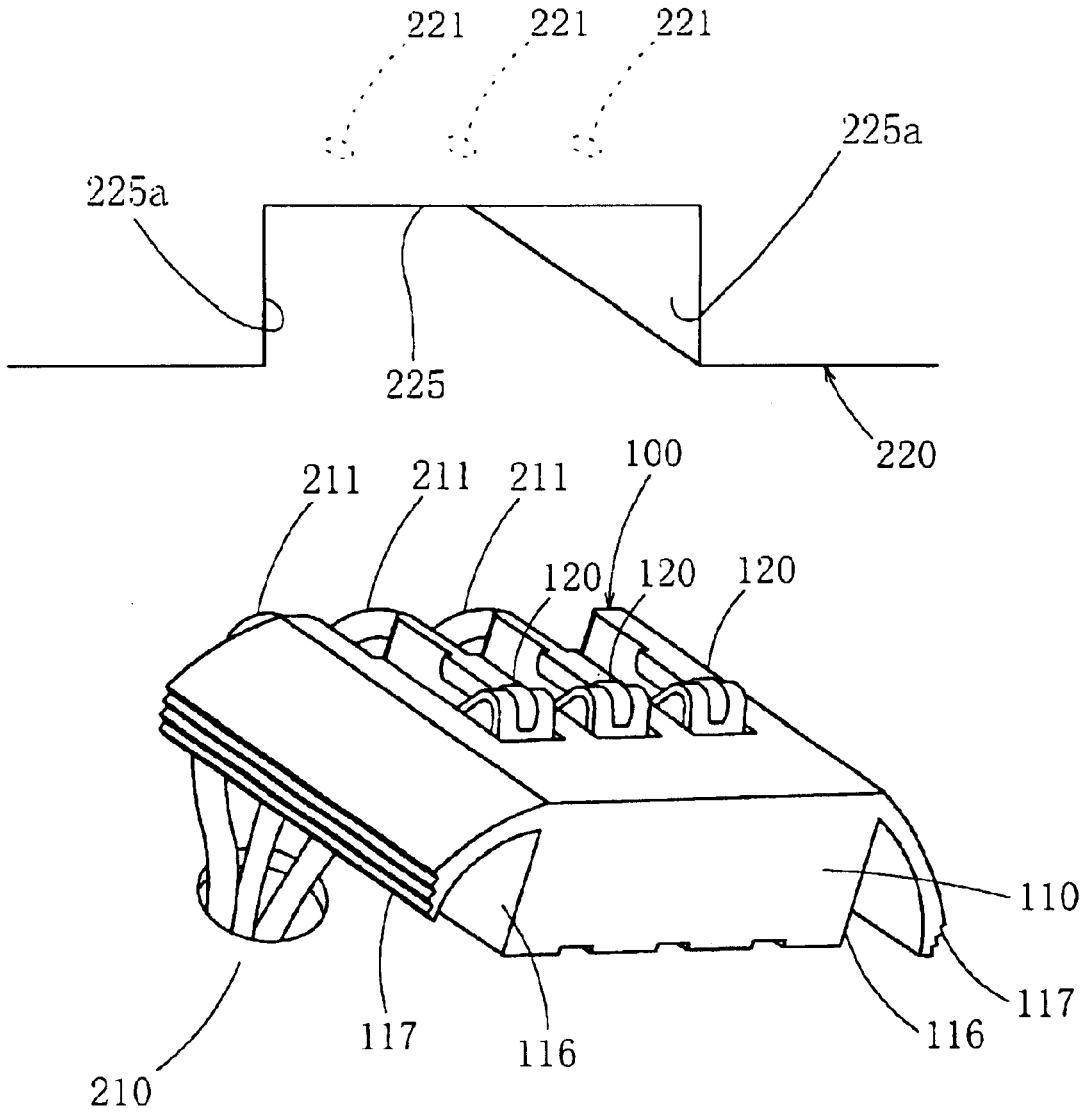
FIG. 11 is a perspective view of the electric connector of the second embodiment when it is being fitted onto the second article.

FIG. 11 shows another connecting form of the electric connector 100 of the above-mentioned second embodiment. In the case of this connecting form, the housing 110 is fitted onto the second article 220. To this end, a concaved part 225 is formed in the second article 220, and the housing 110 is formed in such a way that it can be inserted into the concaved part 225 and is provided with wings 117, which are elastically deformed to press against the longitudinal walls 225*a* of the concaved part 225 when the housing 110 is inserted into the concaved part 225. The electric connector 100 is fitted into this concaved part 225 in such a way that the height direction of the electric connector 100 aligns with the depth direction of the concaved part 225 and the contacting part 122 opposes to the bottom of the concaved part 225. The method of electrically connecting the articles 210, 220 with the electric connector 100 in this connecting form is similar to that of the connecting form shown in FIG. 6 and FIG. 7.

The second embodiment in each connecting form can exhibit operation and effect similar to those of the first embodiment, and the second embodiment provides a high fitting force with a simple construction. Moreover, as dimensional errors, which occur in the internal dimensions of the concaved parts 212, 225, are absorbed by deflection of the wings 117, in turn, the yields of the articles 210, 220 and the electric connector 100 are improved. When the wings 117 are provided on both ends, in the width direction, of the housing 110, the elastic restoring forces of the wings 117 will work on both the ends, in the width direction, of the housing 110 and, in turn, after fitting, the electric connector 100 will be held stably on the article 210, 220. This is preferable.

Figure 12:
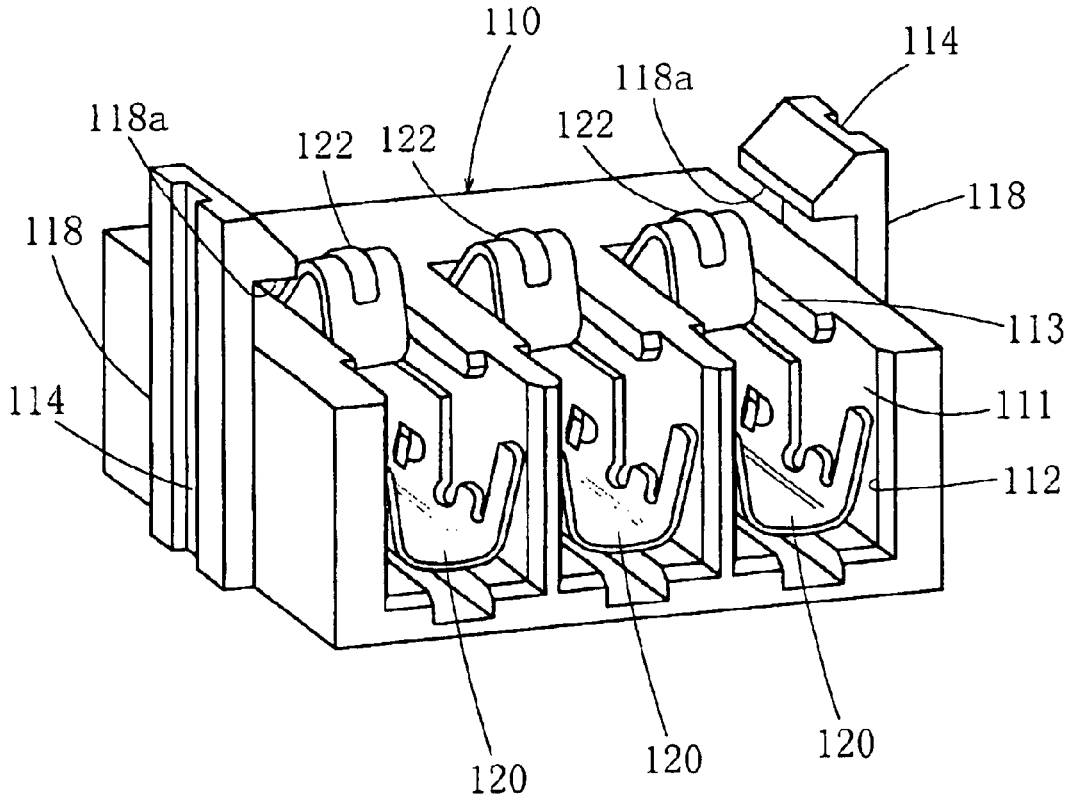
FIG. 12 is perspective view of the electric connector of the third embodiment.
Figure 13:
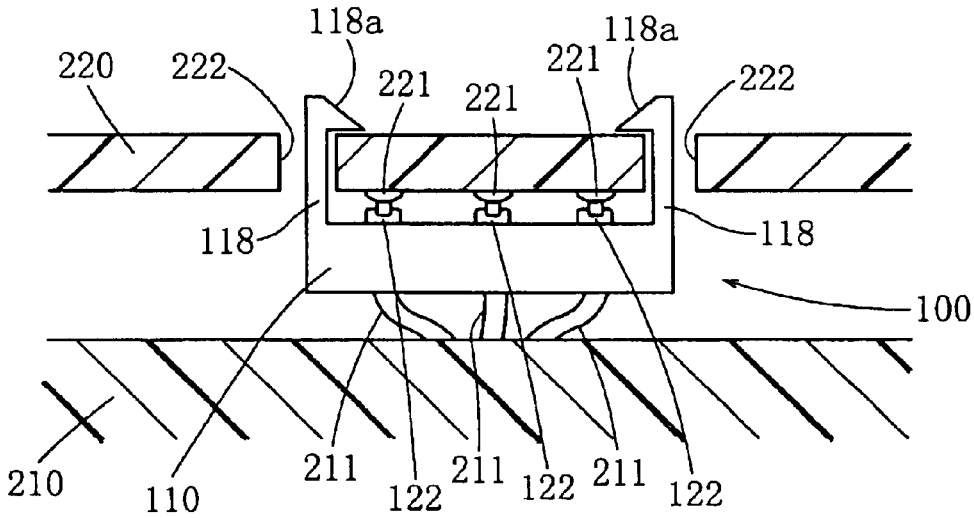
FIG. 13 is a front view of the electric connector of the third embodiment when it is used by fitting it onto the second article.

FIG. 12 shows the electric connector 100 of the third embodiment. In the electric connector 100 of this third embodiment, the housing 110 is provided with locking pawls 118, and the housing 100 is fitted onto an article by fitting the locking pawls 118 onto the article. In the case of this embodiment, the locking pawls 118 extend on both ends, in the width direction, of the housing 110 in the direction of height. A hook 118*a* is provided on the top end of each locking pawl 118, and this hook 118*a* enters a locking hole formed in an article and hooks on the edge of the locking hole. In the case of the connecting form shown in FIG. 13, the housing 110 is fitted onto the second article 220. To this end, locking holes 222 are formed in the second article 220, and the locking pawls 118 extend protrusively from the face of the housing 110, on which the contacting parts 122 are exposed. The electric connector 100 is held in such a way that the contacting parts 122 oppose to the conductive parts 221 of the second article 220, and the locking pawls 118 are fitted on the second article 220. The method of electrically connecting the articles 210, 220 with the electric connector 100 in this connecting form is similar to that of the connecting form shown in FIG. 6 and FIG. 7.

Figure 14:
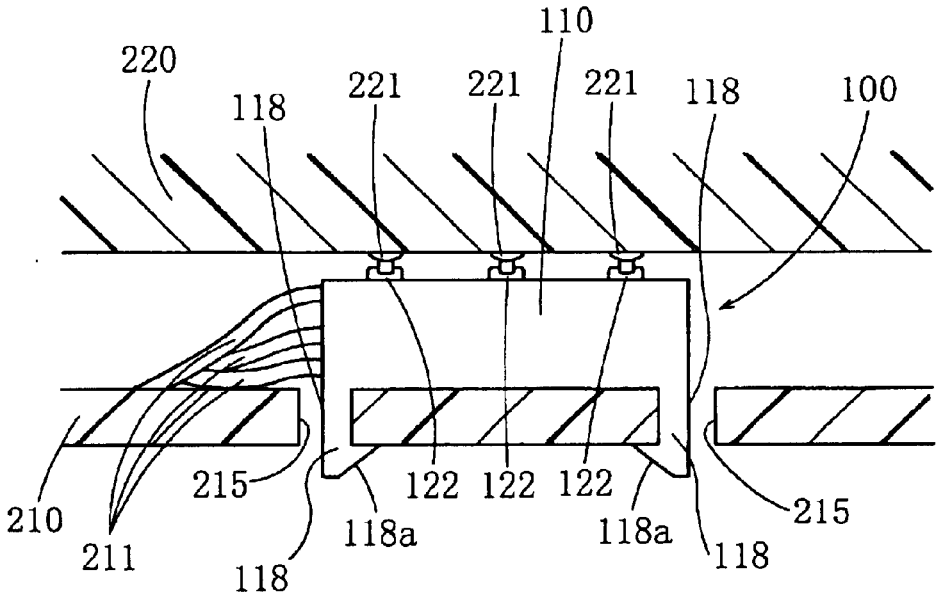
FIG. 14 is a front view of the electric connector of the third embodiment when it is used by fitting it onto the first article.

FIG. 14 shows another connecting form of the electric connector 100 of the above-mentioned third embodiment. In the case of this connecting form, the housing 100 is fitted onto the first article 210. To this end, locking holes 215 are formed in the first article 210, and the locking pawls 118 extend protrusively from the face of the housing 110, which is opposite, in the height direction, to the face on which the contacting parts 122 are exposed. The electric connector 100 is held in such a way that the face being opposite, in the height direction, to the contacting parts 122 opposes to the first article 210, and the locking pawls 118 are fitted onto the first article 210. The method of electrically connecting the articles 210, 220 with the electric connector 100 in this connecting form is similar to that of the connecting form shown in FIG. 1 through FIG. 3.

The third embodiment in each connecting form exhibits operation and effect similar to those of the first embodiment, and high fitting force is provided by a simple structure. When the locking pawls 118 are provided on both ends, in the width direction, of the housing 110, the fitting forces of the locking pawls 118 will work on both ends, in the width direction, of the housing 110, and, in turn, the electric connector 100 will be held stably on both the articles 210, 220 after fitting, and this is preferable.

Figure 15:
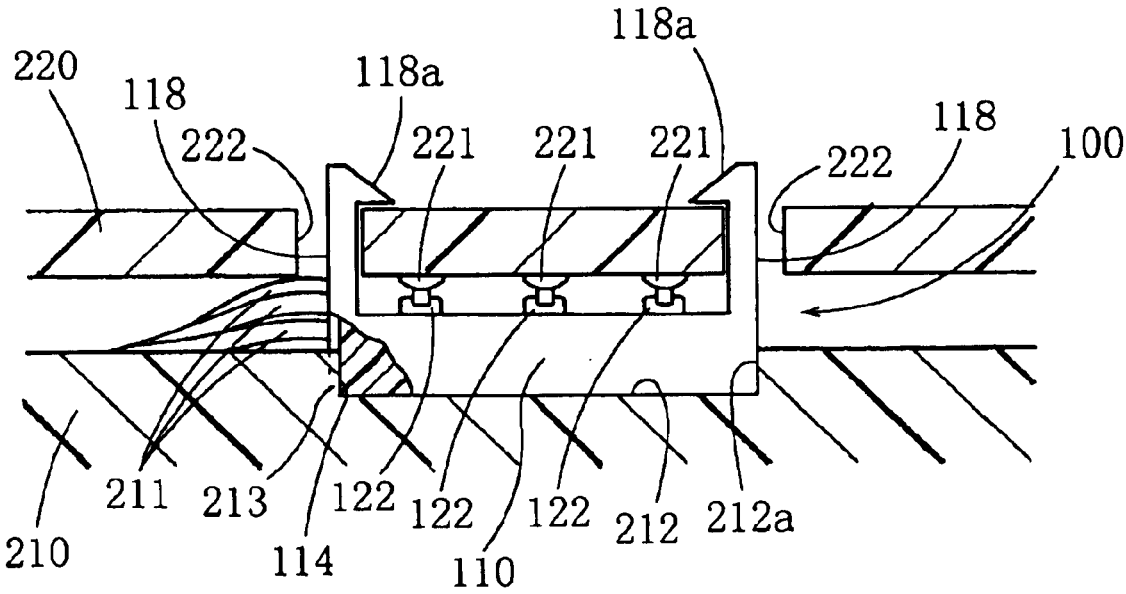
FIG. 15 is a front view of the electric connector of the third embodiment when it is used by fitting it onto both the first article and the second article.

The present invention includes all embodiments wherein features of the embodiments described above are combined. The fitting forms of the first embodiment, the fitting forms of the second embodiment, and the fitting forms of the third embodiment can be combined in the fitting form of fitting one housing 110 onto both the first article 210 and the second article 220, and the present invention includes all of these embodiments. One example shown in FIG. 15 is an embodiment wherein one housing 110 is fitted onto the first article 210 by the fitting form of the first embodiment and onto the second article 220 by the fitting form of the third embodiment. In the case of this embodiment, as shown in FIG. 12, when necessary, a fitting groove 114 is provided in the outside face of each locking pawl 118 and guiding protrusions 213 are provided on the first article 210. In this way, the fitting-in force between the housing 110 and the concaved part 212 can be increased. When this form of fitting one housing 110 onto both the first article 210 and the second article 220 is used, as explained in relation to the first embodiment, in addition to the operation and effect that are obtained by the form of fitting one housing 110 onto the first article 210 or the second article 220, the two articles 210, 220 are joined together by the electric connector 100. Hence there will be no need of separately joining the two articles 210, 220 by a joining means such as screw. Thus the costs are reduced through the elimination of a joining means.

Figure 16:
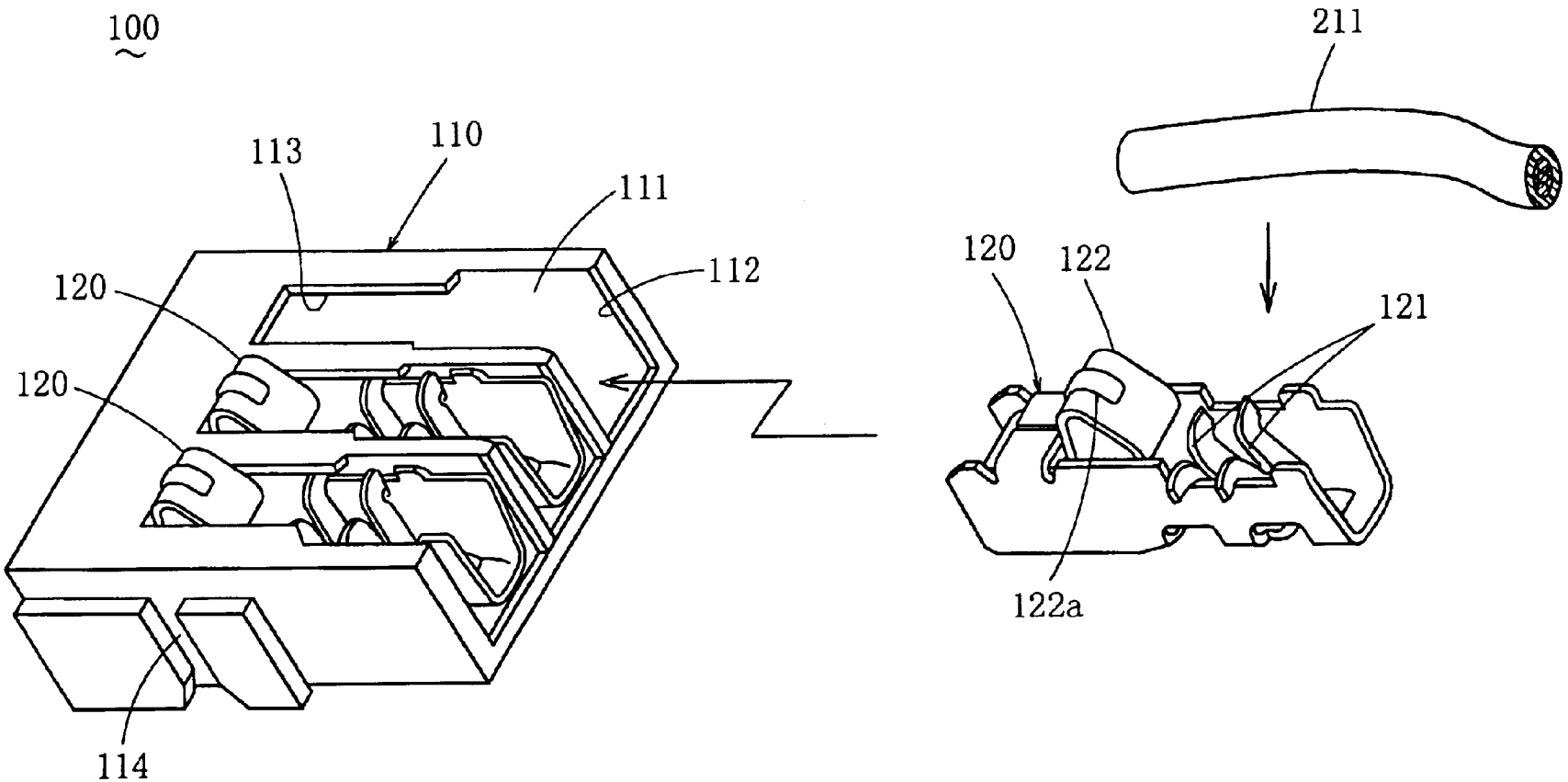
FIG. 16 is a perspective view of the disassembled electric connector of the fourth embodiment.

FIG. 16 shows the fourth embodiment. The fourth embodiment is applicable to any of the above-mentioned embodiments. The electric connector 100 of this fourth embodiment differs from the electric connectors 100 of the first embodiment through the third embodiment in that the contact 120 is of the insulation displacement connection type, and is identical to them in other aspects of the construction. Accordingly, the connecting part 121 is a slot that is formed in one end, in the longitudinal direction, of the contact 120. The core of an electric wire being the conductive part 211 of the first article 210 is connected into this slot by insulation displacement connection.

In the fourth embodiment, when the contact 120 of the electric connector 100 is to be connected to the electric wire being the conductive part 211 of the first article 210, the slot being the connecting part 121 of the contact 120 is connected to the electric wire by insulation displacement connection.

In addition to the embodiments mentioned above, the present invention includes a variety of embodiments. For example, the present invention includes embodiments wherein the housing is fitted onto an article by using an adhesive, and embodiments wherein the housing is fitted onto an article by using a tape or the like, which achieves fitting by a frictional force, for example, Velcro fastener. The present invention also includes embodiments wherein the conductive part of the first article is a conductive pad, and the electric connector is fitted onto the first article and the contact is made to contact the conductive pad to make the electrical connection.

With the description of these embodiments, the first electric connector, which was described in the summary of the invention, has been fully disclosed. Moreover, with the description of these embodiments, the second electric connector through the fifth electric connector, which will be described below, have been fully disclosed.

The second electric connector is an electric connector as recited in the first electric connector wherein the housing is formed in such a way that it can be fitted into a concaved part formed in an article, and the housing is fitted onto the article by this fitting-in. With this arrangement, when the electric connector is fitted into the concave part of the article, the electric connector will be fitted onto the article. Hence the workability of fitting is good.

The third electric connector is an electric connector as recited in the first or second electric connector wherein the housing is formed in such a way that it can be inserted into a concaved part formed in an article, the housing is provided with a wing, which is elastically deformed to press the longitudinal wall of the concaved part when the housing is inserted into the concaved part, and the housing is fitted onto the article by the pressure of the wing. With this arrangement, a high fitting force is provided by a simple structure. Moreover, as the dimensional errors in the inside dimensions of the concaved part are absorbed by the flexion of the wing, the yields of the article and the electric connector are improved.

The fourth electric connector is an electric connector as recited in any electric connector of the first electric connector through the third electric connector, wherein the housing is provided with a locking pawl and the housing is fitted onto an article by fitting the locking pawl onto the article. With this arrangement, a high fitting force is obtained by a simple structure.

The fifth electric connector is an electric connector according to any one of the first through the fourth electric connectors, wherein the connecting part of the contact is a barrel, which is crimp-connected to an electric wire being the conductive part of the first article, or a slot, which is insulation-displacement-connected to the electric wire. With this arrangement, when the conductive part of the first article is an electric wire, the connection between the connecting part of the contact of the electric connector and the conductive part of the first article is made by crimp connection or insulation displacement connection.

What is claimed is:

1. A combination for establishing an electrical and mechanical interconnection, comprising:

a first article including a first article casing and a first conductive part being an electric wire;

a second article including a second article casing and a second conductive part; and an electrical connector including an electrically insulating housing with a cavity therein, an electrically conductive contact member that is received at least partially in said cavity of said housing, and a connector-side mechanical fixing structure provided on said housing;

wherein said contact member includes a crimped wire terminal that is mechanically and electrically connected to said electric wire of said first article by being crimped thereon, and a contacting part that is exposed from said housing and pressed against and electrically contacted with said second conductive part of said second article;

wherein one casing of said first article casing and said second article casing has a first recess in said casing, said housing of said electrical connector is at least partially fitted into and received in said first recess, and said connector-side mechanical fixing structure mechanically engages with a portion of said one casing and thereby mechanically fixes said electrical connector thereto; and wherein said portion of said one casing comprises a casing-side mechanical fixing structure in said first recess, and said connector-side mechanical fixing structure is mechanically engaged with said casing-side mechanical fixing structure.

2. The combination according to claim 1, wherein said connector-side mechanical fixing structure comprises a fitting groove, said casing-side mechanical fixing structure comprises a protrusion on a sidewall of said first recess, and said protrusion fittingly engages into said fitting groove when said electrical connector is at least partially fitted into and received in said first recess.

3. The combination according to claim 1, wherein said connector-side mechanical fixing structure comprises a locking pawl protruding from said housing, said casing-side mechanical fixing structure comprises a catch rim, and said locking pawl engages onto said catch rim when said electrical connector is at least partially fitted into and received in said first recess.

4. The combination according to claim 1, wherein said casing-side mechanical fixing structure comprises a sidewall of said first recess, said connector-side mechanical fixing structure comprises at least one elastically deflectable wing protruding laterally from said housing, and said elastically deflectable wing is elastically deflected and elastically urged to press and engage against said sidewall when said electrical connector is at least partially fitted into and received in said first recess.

5. The combination according to claim 1, wherein said housing of said electrical connector is press-fitted and frictionally engaged into said first recess.

6. The combination according to claim 1, wherein another casing of said first article casing and said second article casing not having said first recess has a second recess therein, and said housing of said electrical connector is at least partially fitted into and received in said second recess.

7. The combination according to claim 1, wherein said second conductive part of said second article is a circuit board contact pad, and said first article casing is said one casing that has said first recess therein.

8. The combination according to claim 1, wherein said second conductive part of said second article is a circuit board contact pad, and said second article casing is said one casing that has said first recess therein.

* * * * *